US007523632B2

(12) United States Patent
Shore

(10) Patent No.: US 7,523,632 B2
(45) Date of Patent: Apr. 28, 2009

(54) MODULAR ROLLING MILL

(75) Inventor: T. Michael Shore, Princeton, MA (US)

(73) Assignee: Morgan Construction Company, Worcester, MA (US)

( * ) Notice: Subject to any disclaimer, the term of this patent is extended or adjusted under 35 U.S.C. 154(b) by 315 days.

(21) Appl. No.: 11/675,143

(22) Filed: Feb. 15, 2007

(65) Prior Publication Data

US 2008/0196469 A1 Aug. 21, 2008

(51) Int. Cl.
*B21B 13/12* (2006.01)
*B21B 31/07* (2006.01)

(52) U.S. Cl. ..... 72/235; 72/249

(58) Field of Classification Search ..... None
See application file for complete search history.

(56) References Cited

U.S. PATENT DOCUMENTS

| | | | | |
|---|---|---|---|---|
| 2,757,556 | A * | 8/1956 | Uehing | 475/6 |
| 3,587,277 | A | 6/1971 | Pigni et al. | |
| 3,665,746 | A | 5/1972 | Eibe | |
| 3,765,212 | A | 10/1973 | Moslener | |
| 3,831,417 | A | 8/1974 | Ritter et al. | |
| 4,019,360 | A * | 4/1977 | Biernot et al. | 72/249 |
| 4,038,855 | A | 8/1977 | Scheib | |
| 4,182,148 | A | 1/1980 | Gilvar | |
| 4,408,474 | A | 10/1983 | Hutzenlaub et al. | |
| 4,411,170 | A | 10/1983 | Vogelgesang | |
| 4,537,055 | A | 8/1985 | Woodrow et al. | |
| 4,706,479 | A | 11/1987 | Tominaga | |
| 4,744,234 | A | 5/1988 | Poloni | |
| 4,903,518 | A | 2/1990 | Kimura et al. | |
| 4,907,438 | A | 3/1990 | Sasaki et al. | |
| 5,144,828 | A | 9/1992 | Grotepass et al. | |
| 5,152,165 | A | 10/1992 | Shore et al. | |
| 5,247,820 | A | 9/1993 | Panaccione | |
| 5,595,083 | A | 1/1997 | Shore | |
| 6,053,022 | A | 4/2000 | Shore | |
| 7,191,629 | B1 * | 3/2007 | Shore et al. | 72/235 |

FOREIGN PATENT DOCUMENTS

| | | |
|---|---|---|
| DE | 1874006 | 6/1963 |
| DE | 1602082 | 2/1970 |
| DE | 1527659 | 3/1970 |
| DE | 1910431 | 9/1970 |
| DE | 2845052 | 4/1980 |
| JP | 57-088908 | 6/1982 |

* cited by examiner

*Primary Examiner*—Sam Chuan C Yao
*Assistant Examiner*—Mohammad Yusuf
(74) *Attorney, Agent, or Firm*—Gauthier & Connors LLP

(57) ABSTRACT

A modular rolling mill comprises a plurality of rolling units having work rolls configured and arranged to progressively reduce the cross sectional area of a product received along a mill pass line. Gear units are mechanically coupled to each rolling unit, with each gear unit in turn being mechanically coupled to a driven line shaft by first bevel gear sets. The ratios of the first bevel gear sets progressively increase from the first to the last of the gear units to thereby accommodate a progressively increasing speed of the product being rolled. A second bevel gear set is associated with the last gear unit. The ratio of the second bevel gear set is the same as the ratio of the first level gear set of the penultimate gear unit. The line shaft is selectively coupled to the last gear unit via one or the other of its first and second bevel gear sets.

4 Claims, 4 Drawing Sheets

MODULAR ROLLING MILL

BACKGROUND DISCUSSION

1. Field of the Invention

This invention relates generally to rolling mills producing long products such as rods and bars, and is concerned in particular with the provision of an improved modular mill.

2. Description of the Prior Art

Examples of known modular mills are disclosed in U.S. Pat. Nos. 5,595,083 and 6,053,022. These mills employ multiple motors driving gear boxes detachably coupled to successive rolling units. The rolling units each include roll stands with oval and round roll passes, and are interchangeable and rapidly shiftable onto and off of the mill pass line to thereby accommodate the single family rolling of progressively larger product sizes, as well as thermomechanical rolling at reduced temperatures. Although mechanically sound and advantageously flexible, as compared to block type mills, such modular arrangements are relatively complex and expensive, both to purchase and subsequently to maintain.

As disclose in U.S. patent application Ser. No. 11/403,671, it is also known to provide a modular rolling mill having successively arranged rolling units which are detachably coupled to gear units driven by a line shaft powered by a single motor. This arrangement also efficiently accommodates the single family rolling of progressively larger products and is less complicated and expensive than modular mills driven by multiple motors. However, it is not readily adaptable to thermomechanical rolling, which requires the introduction of relatively drastic cooling between selected rolling units.

The objective of the present invention is to provide an improved modular mill that is readily adaptable both to the single family rolling of progressively larger products, and to the introduction of interstand cooling when subjecting products to thermomechanical rolling.

SUMMARY OF THE INVENTION

In accordance with the present invention, a modular rolling mill comprises a plurality of rolling units having work rolls configured and arranged to progressively reduce the cross sectional area of a product received along a mill pass line. Gear units are mechanically coupled to each rolling unit. Each gear unit is in turn mechanically coupled to a driven line shaft by first bevel gear sets. The ratios of the first bevel gear sets are progressively increased from the first to the last of the gear units to thereby accommodate the progressively increasing speed of the product being rolled.

A second bevel gear set is associated with the last gear unit. The ratio of the second bevel gear set is the same as the ratio of the first bevel gear set of the immediately preceding (penultimate) gear unit. A clutch mechanism is provided for selectively coupling one or the other of the first and second bevel gear sets of the last gear unit to the line shaft.

In one operational mode, when all rolling units are in service, the first bevel gear set of the last gear unit is engaged. In a second operational mode, the penultimate rolling unit is removed and replaced by a cooling assembly which cools the product in advance of the last rolling unit, and the second bevel gear set of the last gear unit is engaged, allowing the last rolling unit to thermomechanically roll the thus cooled product at the speed of and in place of the removed penultimate rolling unit.

These and other features and advantages of the present invention will now be described in further detail with reference to the accompanying drawings, wherein:

DETAILED DESCRIPTION

Figure 1:
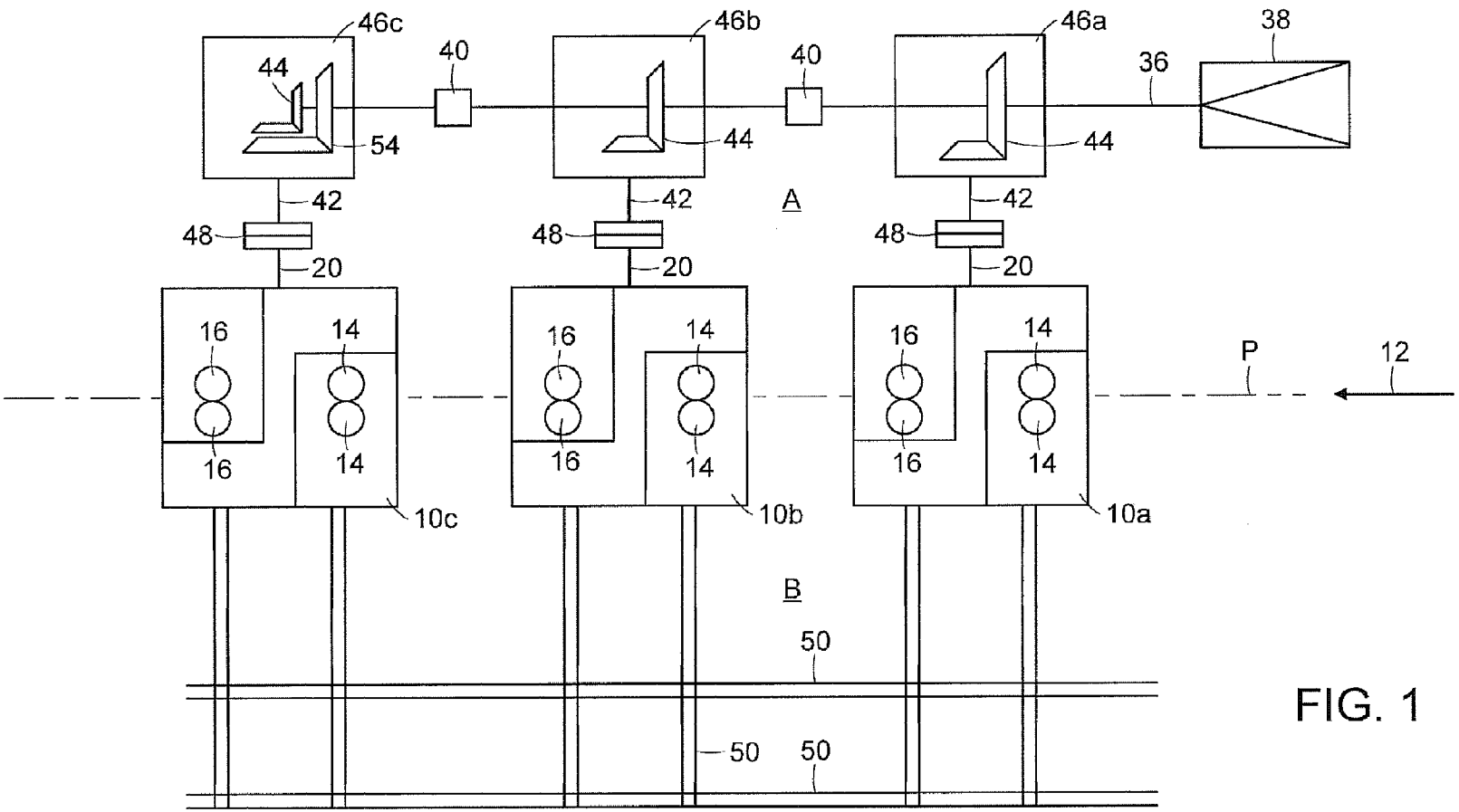
FIG. 1 is a plan view of a modular rolling mill in accordance with the present invention.

With reference to FIG. 1, a modular rolling mill in accordance with the present invention comprises a plurality of separate rolling units 10*a*, 10*b*, and 10*c* arranged along a mill pass line "P." The direction of rolling is indicated by arrow 12. Each rolling unit has at least two pairs of work rolls 14, 16 configured respectively to define oval and round roll passes. The rolls of each successive pair are staggered by 90° to effect twist-free rolling of long products, e.g., bars, rods, and the like.

Figure 2:
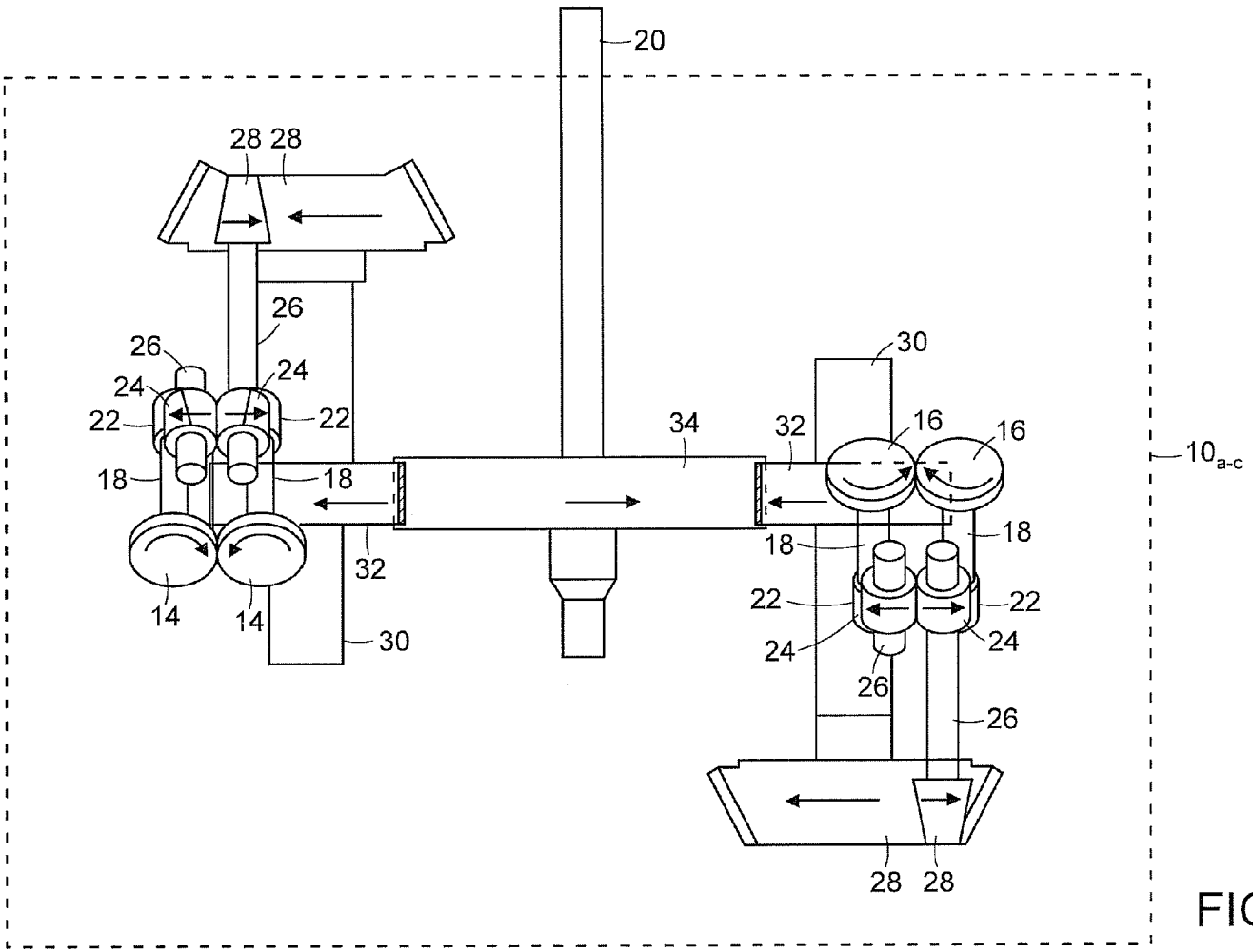
FIG. 2 is a schematic showing of the intermediate drive train contained in each of the rolling units, with the work rolls shown 90° out of position for ease of illustration.
Figure 3:
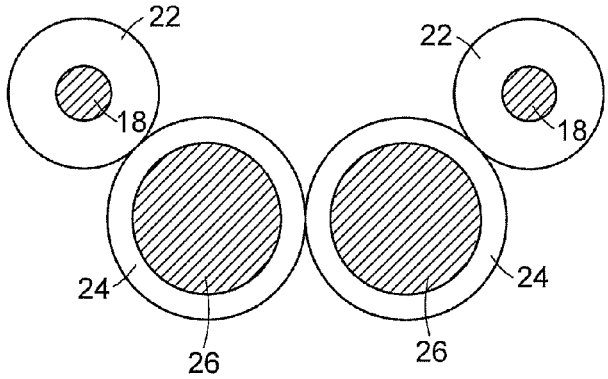
FIG. 3 illustrates the relationship of the gears in the four gear cluster incorporated in the intermediate drive trains.

With reference additionally to FIGS. 2 and 3, it will be seen that the work rolls are mounted on roll shafts 18, and that intermediate drive trains are contained within the rolling units to mechanically couple the roll shafts to input shafts 20. The input shafts are parallel and project to a first side "A" of the pass line. The intermediate drive trains include gears 22 on the roll shafts meshing with intermeshed gears 24 on shafts 26, with one of the shafts 26 connected by a bevel gear set 28 to a shaft 30. The shafts 30 carry gears 32 meshing with a gear 34 on the input shaft 20.

Although not shown, it will be understood that as an alternative to this arrangement, the intermediate drive trains could be configured to drive each pair of work rolls 14, 16 with separate input shafts 20.

A line shaft 36 extends along the first side A in parallel relationship to the pass line P. The line shaft is directly coupled to and driven by a drive motor 38 located at the entry end of the mill.

The line shaft is subdivided into segments interconnected by clutches 40. Each line shaft segment is coupled to an output shaft 42 by a first bevel gear set 44 contained in a gear unit 46*a*, 46*b*, and 46*c* associated with a respective rolling unit.

A coupling 48 connects each output shaft 42 to a respective input shaft 20. The couplings are separable to accommodate removal of the rolling units to the second opposite side "B" of the pass line. A network of tracks 50 on side B is arranged to receive and convey rolling units removed from the pass line.

The ratios of the first bevel gear sets 44 are progressively increased from the first to the last of the gear units (viewed from right to left in FIG. 1). This accommodates the progressively increasing speed of the product being rolled along the pass line P.

Figure 4:
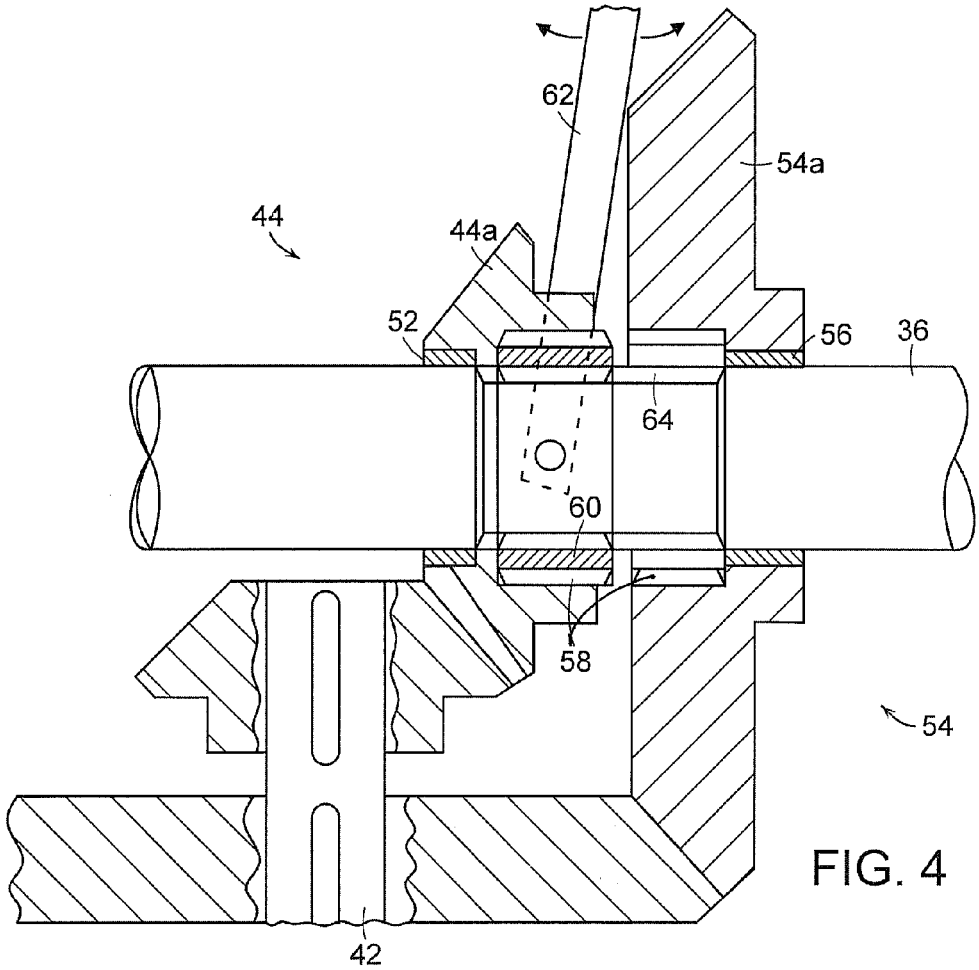
FIG. 4 is an enlarged view of the bevel gear sets and clutch mechanism incorporated in the last gear unit.

The first bevel gear sets of gear units 46*a* and 46*b* are permanently coupled to the line shaft 36. However, in the last gear unit 46*c*, as can best be seen by further reference to FIG. 4, the drive gear 44*a* of the first bevel gear set is journalled by means of a bushing 52 for rotation on the line shaft 36. A second bevel gear set 54 is also contained in the last gear unit 46*c*. The ratio of the second bevel gear set 54 is identical to the ratio of the first bevel gear set 44 of the penultimate gear unit 46*b*, and its drive gear 54*a* is also journalled for rotation relative to the line shaft 36 by means of a bushing.

The drive gears 44*a* and 54*a* are internally splined as at 58. A clutch sleeve 60 is axially shiftable on the line shaft 36 by means of a clutch arm 62 or the like. The clutch sleeve is internally splined for mechanical interengagement with a splined segment 64 of the line shaft, and is externally splined for selective engagement with the internal splines 58 of one or the other of the drive gears 44*a*, 54*a*. When shifted to the position shown in FIG. 4, the clutch sleeve 60 mechanically couples the first drive gear 44*a* and hence first bevel gear set 44 with the line shaft, thus driving the last rolling unit 10*c* at the speed required to handle products emerging from the penultimate rolling unit 10*b*.

Figure 5:
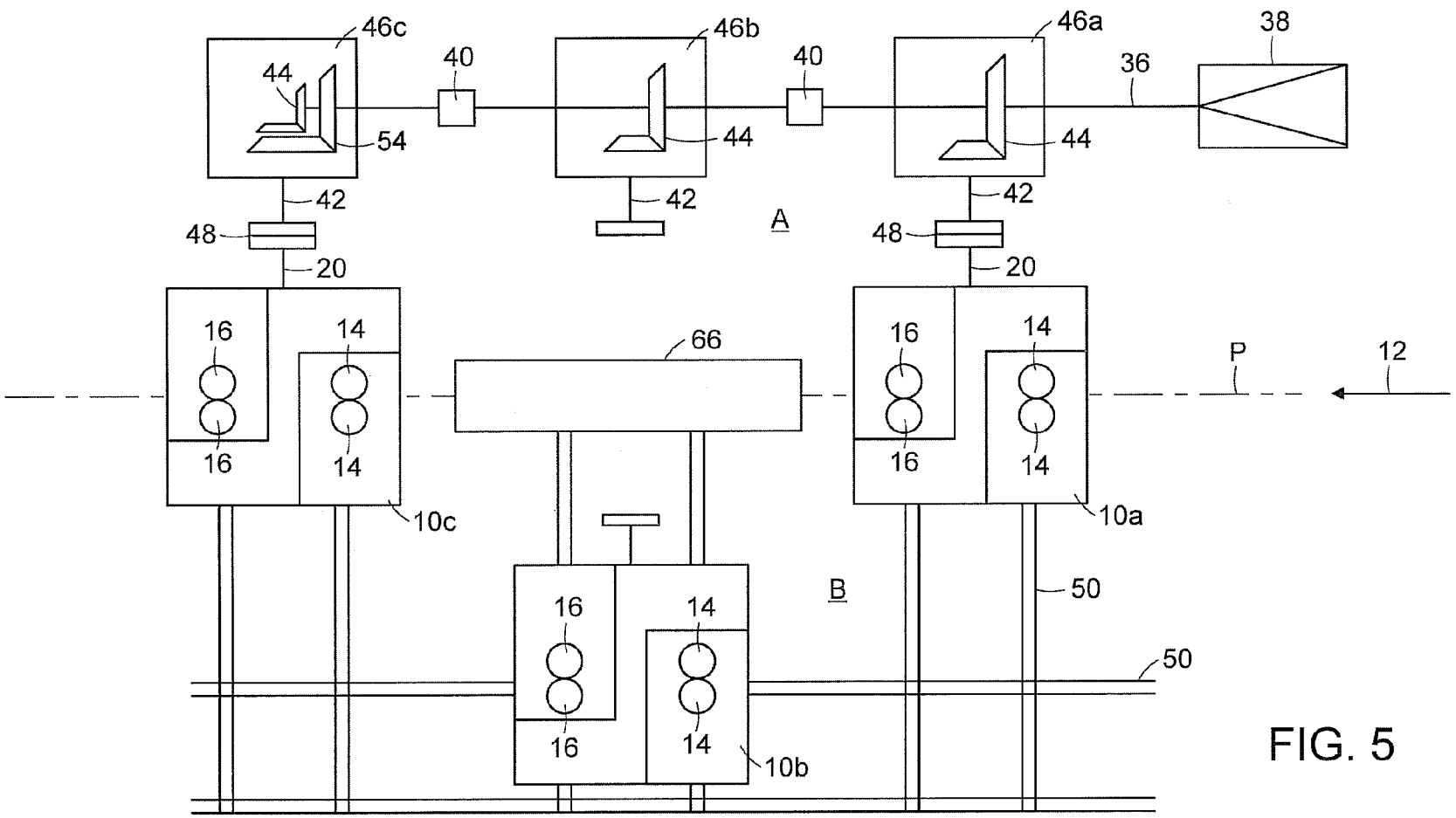
FIG. 5 is a view similar to FIG. 1 showing the mill reconfigured to accommodate thermomechanical rolling.

As shown in FIG. 5, in an alternative operational mode, the penultimate rolling unit 10*b* is shifted off of the pass line P onto the tracks 50, and is replaced by a cooling unit 66, which typically will comprise a series of water boxes or the like. In concert with this change, the clutch sleeve 60 will be shifted to the right (as viewed in FIG. 4), thus mechanically disengaging the first drive gear 44*a* from the line shaft 36 while simultaneously coupling the second drive gear 54*a* to the line shaft.

The last rolling unit 10*c* will thus be driven at the same speed as the now sidelined penultimate rolling unit 10*b*, which is the correct speed for thermomechanically rolling the cooled product previously rolled in the first rolling unit 10*a*.

In light of the foregoing, it will be appreciated by those skilled in the art that other equivalent mechanisms may be employed to selectively couple the line shaft 36 to the last gear unit via its first or second bevel gear sets 44, 54. A non-limiting example of one such equivalent mechanism might entail arranging one bevel gear of each gear set on a splined shaft segment, with means for axially shifting that gear into and out of engagement with its mating bevel gear.

I claim:

1. A modular rolling mill comprising:

a plurality of rolling units having work rolls configured and arranged to progressively reduce the cross sectional area of a product received along a mill pass line;

gear units mechanically coupled to each rolling unit, each gear unit in turn being mechanically coupled to a driven line shaft by first bevel gear sets, the ratios of said first bevel gear sets being progressively increased from the first to the last of said gear units to thereby accommodate a progressively increasing speed of the product being rolled;

a second bevel gear set associated with the last of said gear units, the ratio of said second bevel gear set being the same as the ratio of the first bevel gear set of the penultimate gear unit; and means for selectively coupling said line shaft to the last gear unit via one or the other of its first and second bevel gear sets.

2. The modular rolling mill of claim 1 further comprising a cooling unit adapted to be mounted along said mill pass line in place of the penultimate rolling unit, said cooling unit being operative to cool said product in advance of its being rolled in the last rolling unit, and with the last gear unit being driven by said line shaft via said second bevel gear set.

3. The modular rolling mill of claims 1 or 2 wherein said gear units and said line shaft are arranged along a first side of said mill pass line, and wherein at least said penultimate rolling unit is removable from said mill pass line to an opposite second side thereof.

4. A modular rolling mill, comprising:

a plurality of rolling units arranged along a mill pass line, each rolling unit comprising at least two pairs of work rolls and an intermediate drive train for mechanically coupling said work rolls to an input shaft projecting to a first side of said pass line;

a driven line shaft parallel to and on the first side of said pass line;

gear units associated with each rolling unit, each gear unit having an output shaft mechanically coupled by a first bevel gear set to said line shaft, with each of said output shafts being connected to a respective one of said input shafts, the ratios of said first bevel gear sets being progressively increased from the first to the last of said gear units in order to accommodate a progressively increasing speed of a product being rolled in said mill;

the last gear unit having an additional second bevel gear set with a ratio identical to the ratio of the first bevel gear of the penultimate gear unit; and clutch means for selectively connecting one or the other of said first and second bevel gear sets of the last gear unit to said line shaft, whereupon the rolling of products at reduced temperatures may be accomplished by replacing the penultimate rolling unit with a cooling unit, coupled with the coupling of said second bevel gear set to said line shaft.

* * * * *